US009972469B2

(12) United States Patent
Naiman et al.

(10) Patent No.: US 9,972,469 B2
(45) Date of Patent: May 15, 2018

(54) CARRIER SHAFT FOR AN ELECTROMECHANICAL SWITCHING DEVICE AND ELECTROMECHANICAL SWITCHING DEVICE

(71) Applicant: Siemens Aktiengesellschaft, München (DE)

(72) Inventors: Pavel Naiman, Letohrad (CZ); Milos Petracek, Letohrad (CZ); Daniel Vavra, Vyprachtice (CZ); Christoph Weber, Ergoldsbach (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 220 days.

(21) Appl. No.: 14/964,647

(22) Filed: Dec. 10, 2015

(65) Prior Publication Data

US 2016/0211099 A1 Jul. 21, 2016

(30) Foreign Application Priority Data

Jan. 20, 2015 (DE) ..... 10 2015 200 825

(51) Int. Cl.
*H01H 71/02* (2006.01)
*H01H 1/20* (2006.01)
*H01H 9/00* (2006.01)

(52) U.S. Cl.
CPC ..... *H01H 71/0207* (2013.01); *H01H 1/2041* (2013.01); *H01H 2009/0094* (2013.01)

(58) Field of Classification Search
CPC ..... H01H 71/0207; H01H 3/22; H01H 19/56; H01H 33/42; H01H 1/2041; H01H 9/0072;
(Continued)

(56) References Cited

U.S. PATENT DOCUMENTS 6,259,338 B1 7/2001 Moeller
7,145,419 B2 * 12/2006 Kim ..... H01H 1/205 218/22
(Continued)

FOREIGN PATENT DOCUMENTS

CN 101399137 A 4/2009
CN 103069519 A 4/2013
CN 202977332 U 6/2013

OTHER PUBLICATIONS

Chinese Office Action dated Jul. 3, 2017.

*Primary Examiner* — Edwin A. Leon
(74) *Attorney, Agent, or Firm* — Harness, Dickey & Pierce, P.L.C.

(57) ABSTRACT

A carrier shaft with a modular structure for an electromechanical switching device of an embodiment includes at least one first carrier module, at least one second carrier module and at least one connecting module, arranged in a torsion-inhibiting manner between the at least one first carrier module and the at least one second carrier module. The connecting module includes a main body and at least one connecting device and the connecting device are arranged in the main body, the at least one first carrier module and the at least one second carrier module. Another embodiment relates to an electromechanical switching device with the carrier shaft.

30 Claims, 4 Drawing Sheets

(58) Field of Classification Search
CPC ..... H01H 71/1009; H01H 73/045; H01H 2009/0094; H01H 2071/1036
USPC ..... 200/237, 50.32; 335/6, 8–10, 201–202
See application file for complete search history.

(56) References Cited

U.S. PATENT DOCUMENTS

| | | | | |
|---|---|---|---|---|
| 7,189,935 | B1 * | 3/2007 | Hassan | H01H 1/20 200/244 |
| 2013/0140158 | A1 | 6/2013 | Dahl Jorg-Uwe | |

* cited by examiner

CARRIER SHAFT FOR AN ELECTROMECHANICAL SWITCHING DEVICE AND ELECTROMECHANICAL SWITCHING DEVICE

PRIORITY STATEMENT

The present application hereby claims priority under 35 U.S.C. § 119 to German patent application number DE 102015200825.8 filed Jan. 20, 2015, the entire contents of which are hereby incorporated herein by reference.

FIELD

At least one embodiment of the present invention generally relates to a carrier shaft with a modular structure for an electromechanical switching device, having at least one first carrier module, at least one second carrier module and at least one connecting module, which is arranged in a torsion-inhibiting manner between the at least one first carrier module and the at least one second carrier module. At least one embodiment of the present invention also generally relates to an electromechanical switching device with such a carrier shaft.

BACKGROUND

Electromechanical switching devices for switching electrical currents are known in the prior art. One class of such electromechanical switching devices is that of devices known as circuit breakers. These circuit breakers comprise a housing in which the individual phases of the currents are switched. The individual phases may be accommodated in pole cassettes, which are enclosed by a housing. Accommodated in the pole cassettes are movable and fixed contacts, which can be moved apart for opening a circuit and brought into contact for closing the circuit.

In circuit breakers, for example compact circuit breakers, generally multiple individual pole cassettes are interconnected and mechanically connected to one another. In the pole cassettes, movable contacts are in turn respectively arranged in a rotor housing. The respective rotor housings, which serve as carrier modules for the movable contacts, must likewise be mechanically connected to one another, so that the movable contacts can be switched on and off together. In the case of such circuit breakers, great forces act on the components of the circuit breaker or the carrier shaft located therein during switching into a TRIP position or during a switching-off operation. In order to avoid damage to the circuit breaker, components with great rigidity and great strength are required.

In the prior art, a rotating carrier shaft for carrying contact arms for a low-voltage protective switch is known for this purpose. This carrier shaft has a modular structure, which comprises along an axis of rotation at least one first carrier module and one second carrier module and a connecting module in between. In the case of the circuit breakers known in the prior art, such a connecting module usually includes plastic and is connected between the carrier modules by way of a plug-in connection of the male-female type. However, such a connecting module of plastic does not offer the desired rigidity between the individual carrier modules. It has also been found in practice that such connecting modules become worn relatively quickly.

Also known in the prior art are circuit breakers in which individual rotor housings are mechanically connected to one another by way of metal shafts. Although such a connection achieves a certain rigidity between the individual rotor housings, a torsion-inhibiting connection of metal does however have disadvantageous effects on the overall weight of the circuit breaker.

SUMMARY

At least one embodiment of the present invention at least partially avoids the disadvantages described above in the case of a carrier shaft for an electromechanical switching device and also in the case of an electromechanical switching device with such a carrier shaft. In particular, at least one embodiment of the present invention provides a carrier shaft for an electromechanical switching device with great rigidity and at the same time a long service life and wear resistance of the carrier shaft. In addition, at least one embodiment of the present invention to provide such a carrier shaft with an improved distribution of stress or forces during a switching operation into a TRIP position or during a switching-off operation of the electromechanical switching device. At least one embodiment of the present invention provides a carrier shaft for an electromechanical switching device in the case of which an uncomplicated, quick and error-free assembly is possible.

At least one embodiment is directed to a carrier shaft and at least one embodiment is directed to an electromechanical switching device with the carrier shaft. Further features of embodiments of the invention emerge from the claims, the description and the drawings. In these, features and details that have been described in conjunction with the carrier shaft also apply of course in conjunction with the electromechanical switching device, and vice versa respectively, so that reference is or can always be made from one to the other with respect to the disclosure of the individual aspects of embodiments of the invention.

According to a first aspect of at least one embodiment of the present invention, a carrier shaft with a modular structure for an electromechanical switching device is provided, having at least one first carrier module, at least one second carrier module and at least one connecting module, which is arranged in a torsion-inhibiting manner between the at least one first carrier module and the at least one second carrier module, the connecting module having a main body and at least one connecting device and the connecting device being arranged in the main body, the at least one first carrier module and the at least one second carrier module.

According to a further aspect of at least one embodiment of the present invention, an electromechanical switching device with a carrier shaft as described above and having the corresponding advantageous features is provided.

Further measures that improve the invention emerge from the following description of individual example embodiments of the invention, which are schematically represented in the figures. All of the features and/or advantages arising from the claims, the description or the drawing, including structural details and spatial arrangements, may be essential to the invention both on their own and in the various combinations.

Figure 1:
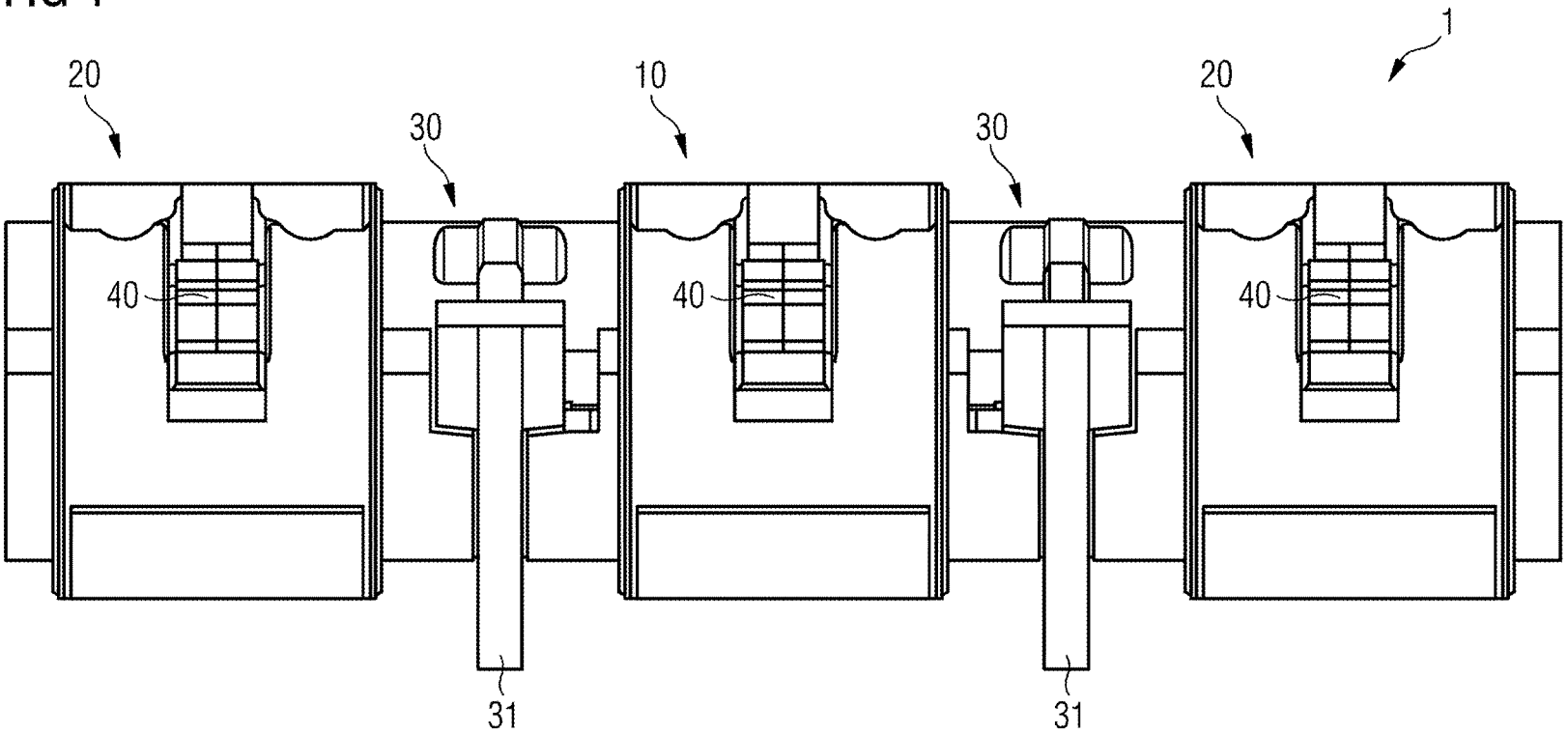
FIG. 1 shows a partial view of a carrier shaft according to one embodiment of the present invention.

Elements with the same function and mode of operation are respectively provided with the same designations in FIGS. 1 to 5.

DETAILED DESCRIPTION OF THE EXAMPLE EMBODIMENTS

The drawings are to be regarded as being schematic representations and elements illustrated in the drawings are not necessarily shown to scale. Rather, the various elements are represented such that their function and general purpose become apparent to a person skilled in the art. Any connection or coupling between functional blocks, devices, components, or other physical or functional units shown in the drawings or described herein may also be implemented by an indirect connection or coupling. A coupling between components may also be established over a wireless connection. Functional blocks may be implemented in hardware, firmware, software, or a combination thereof.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Before discussing example embodiments in more detail, it is noted that some example embodiments are described as processes or methods depicted as flowcharts. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items. The phrase "at least one of" has the same meaning as "and/or".

Further, although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

Spatial and functional relationships between elements (for example, between modules) are described using various terms, including "connected," "engaged," "interfaced," and "coupled." Unless explicitly described as being "direct," when a relationship between first and second elements is described in the above disclosure, that relationship encompasses a direct relationship where no other intervening elements are present between the first and second elements, and also an indirect relationship where one or more intervening elements are present (either spatially or functionally) between the first and second elements. In contrast, when an element is referred to as being "directly" connected, engaged, interfaced, or coupled to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Portions of the example embodiments and corresponding detailed description may be presented in terms of software, or algorithms and symbolic representations of operation on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" of "displaying" or the like, refer to the action and processes of a computer system, or similar electronic computing device/hardware, that manipulates and transforms data represented as physical, electronic quantities within the computer system's registers and memories into other data similarly represented as physical quantities within the computer system memories or registers or other such information storage, transmission or display devices.

According to a first aspect of at least one embodiment of the present invention, a carrier shaft with a modular structure for an electromechanical switching device is provided, having at least one first carrier module, at least one second carrier module and at least one connecting module, which is arranged in a torsion-inhibiting manner between the at least one first carrier module and the at least one second carrier module, the connecting module having a main body and at least one connecting device and the connecting device being arranged in the main body, the at least one first carrier module and the at least one second carrier module.

The fact that the connecting module has a main body and at least one connecting device, i.e. is preferably of a multipart form, and that the connecting device is arranged in, that is to say not just on, the main body, the at least one first carrier module and the at least one second carrier module means that a carrier shaft for an electromechanical switching device with increased rigidity and at the same time a long service life and wear resistance of the carrier shaft is provided. In particular, the provision of a separate main body and the additional at least one connecting device allows a particularly good distribution of stress or forces during a switching operation into a TRIP position or during a switching-off operation of the electromechanical switching device to be provided, since the forces occurring are advantageously transferred to the multiple components.

As a result, a carrier shaft of smaller dimensions, and consequently a switching device of a correspondingly smaller construction, can be advantageously provided.

The fact that the carrier shaft has a modular structure means that it is preferably of a multipart form. The carrier module is for example suitable for carrying or bearing contact arms of the electromechanical switching device. The carrier shaft may for example carry or bear one first carrier module and two second carrier modules, or two first and two second carrier modules. The torsion inhibition between the at least one first carrier module and the at least one second carrier module is provided by the at least one connecting module in such a way that the at least one first carrier module cannot move or twist in relation to the at least one second carrier module, or cannot substantially move or twist in relation thereto, during operation of the carrier shaft or of the electromechanical switching device. This means that the connecting module is preferably arranged between the at least one first carrier module and the at least one second carrier module in such a way that a relative torsion of the at least one first carrier module with respect to the at least one second carrier module can be prevented or can be substantially prevented.

The fact that the connecting module has a main body and at least one connecting device means that the connecting module is preferably of a multipart form. The connecting module has in particular multiple parts that are releasably connected to one another. Releasably means that the various parts connected to one another can be joined together and separated from one another again non-destructively, or substantially non-destructively. It is thus conceivable for example that the connecting device is inserted into or through the main body, that is to say is not just fastened on the main body or protrudes from it.

The at least one connecting device is preferably formed as a connecting pin or connecting pins. In a preferred configuration, two connecting pins are provided as the at least one connecting device, these connecting pins being arranged such that they respectively extend through the main body and with their two ends bear, preferably fit, in the at least one first carrier module and in the at least one second carrier module. However, it is also conceivable that the at least one connecting device is provided as a connecting pin or a plurality of connecting pins, which are respectively arranged on one side of the main body and on only one side of the main body. It is thus conceivable for example that four connecting pins are provided, one pair of connecting pins being arranged on or fitted in one side of the main body and one side of the at least one first carrier module, and another pair of the connecting pins being arranged on or fitted in another side, preferably the opposite side, of the main body and one side of the at least one second carrier module. The connecting pins may for example be fitted in the main body and/or in the carrier modules by way of a press fit.

It is of further advantage according to at least one embodiment of the present invention if the connecting device and the main body comprise different materials with different rigidities. It is particularly preferred for example if the at least one connecting device or the material of the same has a greater rigidity than the main body or the material of the same. It is also possible, however, that the main body or the material of the same has a greater rigidity than the at least one connecting device or the material of the same.

According to an advantageous development of at least one embodiment of the present invention, the connecting device comprises metal or substantially metal, for example steel. Preferably, the connecting device consists completely of metal. Connecting devices of metal achieve a particularly great axial, flexural and torsional rigidity. Connecting means such as connecting pins of metal are easy and inexpensive to produce.

In the case of the carrier shaft according to at least one embodiment of the invention, the main body may, according to one development, comprise plastic or substantially plastic. The main body preferably consists completely of plastic, in particular of a high-strength thermoplastic. It is particularly preferred if the main body comprises or includes a plastic with a relatively great rigidity, for example thermoplastic. A main body of plastic has the advantage that forces can be absorbed particularly well during the operation of the carrier shaft or the electromechanical switching device and it consequently serves for the wear resistance of the carrier shaft or the electromechanical switching device. A main body of a plastic can also be produced at low cost and has a low weight. The main body is in this case not restricted to a thermoplastic.

It is also conceivable according to at least one embodiment of the invention that the main body comprises for example fiber-reinforced plastic or substantially fiber-reinforced plastic or consists completely of fiber-reinforced plastic. Furthermore, it is also possible that the main body only partially comprises plastic, for example a thermoplastic and/or a thermoset, and/or a fiber-reinforced plastic, and otherwise includes some other material. For example, it is also possible that the main body comprises a metal-plastic composite or includes a metal-plastic composite.

It is also of advantage according to at least one embodiment of the invention if the main body has at least one first through-hole, through which at least one carrier module projection of the at least one first carrier module and/or at least one carrier module projection of the at least one second carrier module extend. As a result, a particularly stable torsion protection can be provided between the at least one first carrier module and the at least one second carrier module. The at least one first through-hole is preferably formed as a slot. Particularly preferably, this at least one first through-hole has in the longitudinal direction a uniform curvature or radius which is concentric to the radius of the outer circumference of the carrier shaft or substantially concentric to the radius of the circumference of the carrier shaft or the at least one first carrier module and the at least one second carrier module. The at least one carrier module projection is formed in a correspondingly complementary manner, i.e. in such a way that it can extend through the at least one first through-hole of the main body without any play or substantially without any play. This results in a particularly stable torsion protection between the at least one first carrier module and the at least one second carrier module.

Alternatively, both the at least one first through-hole and the at least one carrier module projection may have a different cross-sectional form than that of a slot. The cross-sectional form may for example also be round or angular. What is decisive is that the cross-sectional form of the at least one first through-hole of the main body and the cross-sectional form of the at least one carrier module projection are complementary to one another in such a way that the at least one carrier module projection can be pushed or inserted through the at least one first through-hole without any play or substantially without any play.

It is also of advantage according to at least one embodiment of the present invention if the main body has at least one second through-hole, in which the connecting device is arranged with a form fit. The at least one second through-hole and the connecting device arranged therein with a form fit allow an even more stable torsion protection to be provided between the at least one first carrier module and the at least one second carrier module. The at least one second through-hole is preferably formed as round, particularly preferably as circular, but may also have an angular cross section. As in the case of the at least one first through-hole, what is decisive is that the cross-sectional form of the at least one second through-hole of the main body and the cross-sectional form of the at least one connecting device are complementary to one another in such a way that the at least one connecting device can be pushed or inserted through the at least one second through-hole with a form fit or without any play or substantially without any play.

According to a further advantageous configuration of at least one embodiment of the present invention, the at least one carrier module projection of the at least one first carrier module is arranged in at least one first clearance of the at least one second carrier module with a form fit and/or the at least one carrier module projection of the at least one second carrier module is arranged in at least one first clearance of the at least one first carrier module with a form fit. As a result, the stability of the torsion protection can be improved further. The at least one first clearance is for example formed as a blind hole for receiving the at least one first carrier module projection with a form fit.

In a preferred configuration, two carrier module projections are provided, arranged in two associated first clearances. The at least one first clearance is preferably respectively configured in at least one further projection of a carrier module. The at least one first clearance is preferably formed as a slot, the form or cross section of which corresponds to that or substantially that of the at least one first through-hole. Particularly preferably, the at least one first clearance has in the longitudinal direction, i.e. in the circumferential direction, of the carrier shaft or the first and second carrier modules a uniform curvature or radius which is concentric to the radius of the outer circumference of the carrier shaft or substantially concentric to the radius of the circumference of the carrier shaft or the at least one first carrier module and the at least one second carrier module. The at least one carrier module projection is formed in a correspondingly complementary manner, i.e. in such a way that it is arranged in the at least one first clearance with a form fit or without any play or substantially without any play.

In addition, according to at least one embodiment of the present invention, the at least one first carrier module and the at least one second carrier module respectively have at least one second clearance, in which the connecting device is arranged with a form fit. This also serves for better stabilization of the torsion protection between the at least one first carrier module and the at least one second carrier module. It is particularly advantageous here if the at least one connecting device and/or the at least one carrier module projection are formed as tapering in an end portion of the same. As a result, a centering or inserting function can be established, by which a particularly uncomplicated, quick and error-free assembly of the carrier shaft is possible. The at least one first and/or at least one second clearance are formed in a correspondingly complementary manner.

Furthermore, according to at least one embodiment of the invention, the main body may have the at least one second through-hole in a portion in which the main body has a greater thickness than in another portion of the main body. As a result, the main body is configured to be as robust as possible in a portion in which a great force transfer takes place. In addition, as a result, a particularly good seating or secure bearing can be ensured for the connecting device. Preferably, the main body has the at least one second through-hole in a portion in which the main body has the greatest thickness when considered in the axial direction of the carrier shaft. This comparatively great thickness may for example be realized by a main body projection or by the fact that the main body has the form of a wedge or substantially the form of a wedge.

It is also of advantage according to at least one embodiment of the invention if the at least one first carrier module, the at least one second carrier module and the at least one connecting module are in contact with one another in a form-fitting manner or substantially form-fitting manner. It is preferred in this case if the at least one first carrier module, the at least one second carrier module and the connecting module are in direct contact with one another.

According to a further aspect of at least one embodiment of the present invention, an electromechanical switching device with a carrier shaft as described above and having the corresponding advantageous features is provided.

FIG. 1 shows a carrier shaft 1 for an electromechanical switching device 100 according to one embodiment of the present invention. The carrier shaft 1 represented in FIG. 1 has one first carrier module 10 and two second carrier modules 20 with contact arms 40 borne therein. A connecting module 30 is respectively arranged between the two second carrier modules 20 and the one first carrier module 10. As FIG. 1 reveals, the carrier shaft is not a uniformly cylindrical shaft, but a modular shaft with different cross sections.

Figure 2:
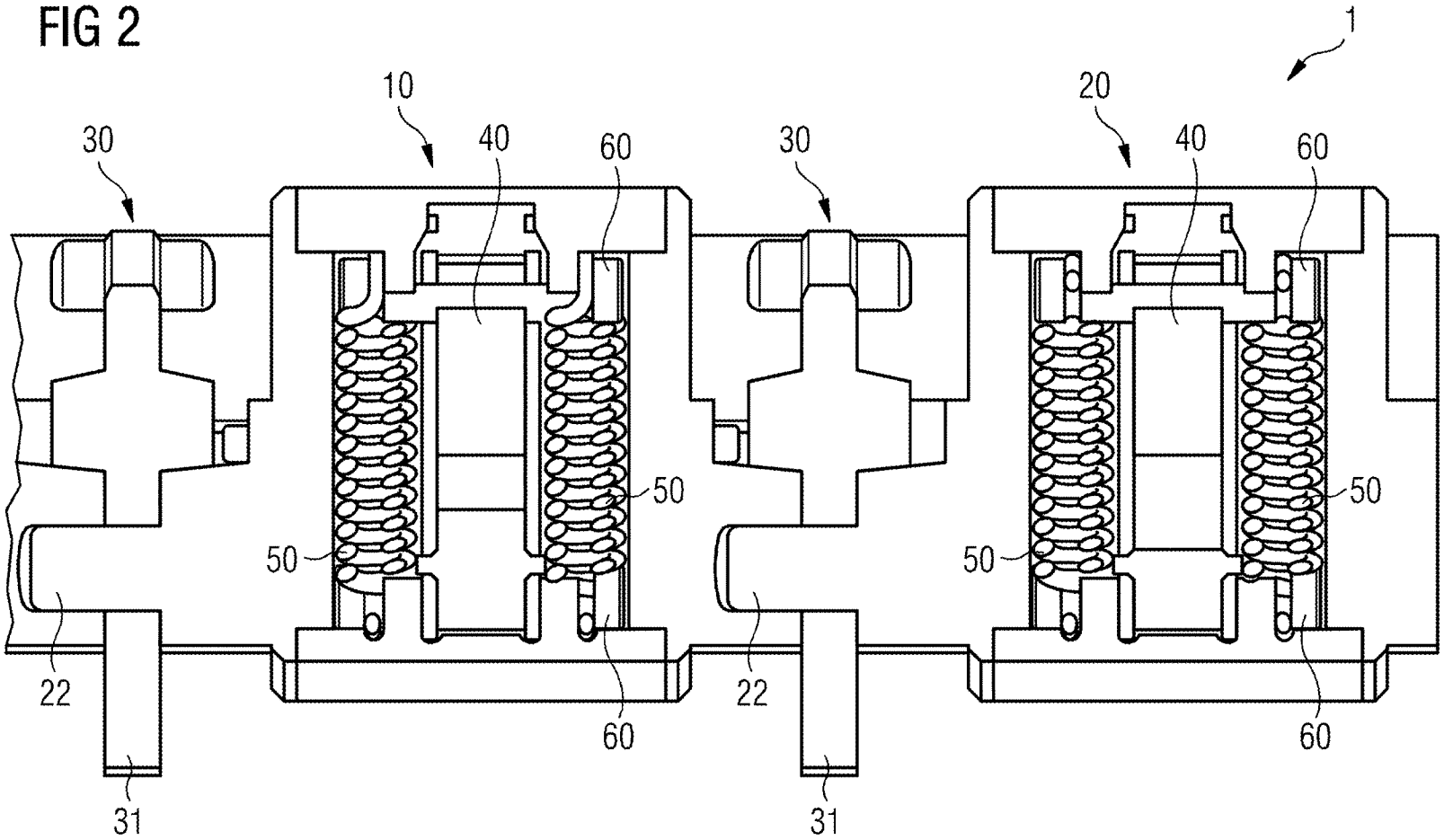
FIG. 2 shows a sectional representation of the carrier shaft according to the one embodiment of the present invention.

FIG. 2 shows a sectional representation of the carrier shaft 1 according to the embodiment of the present invention that is given by way of example. Contact arms 40, spring elements 50 and bearing bolts 60 are borne in the carrier modules 10, 20, which are substantially formed as rotor housings.

Figure 3:
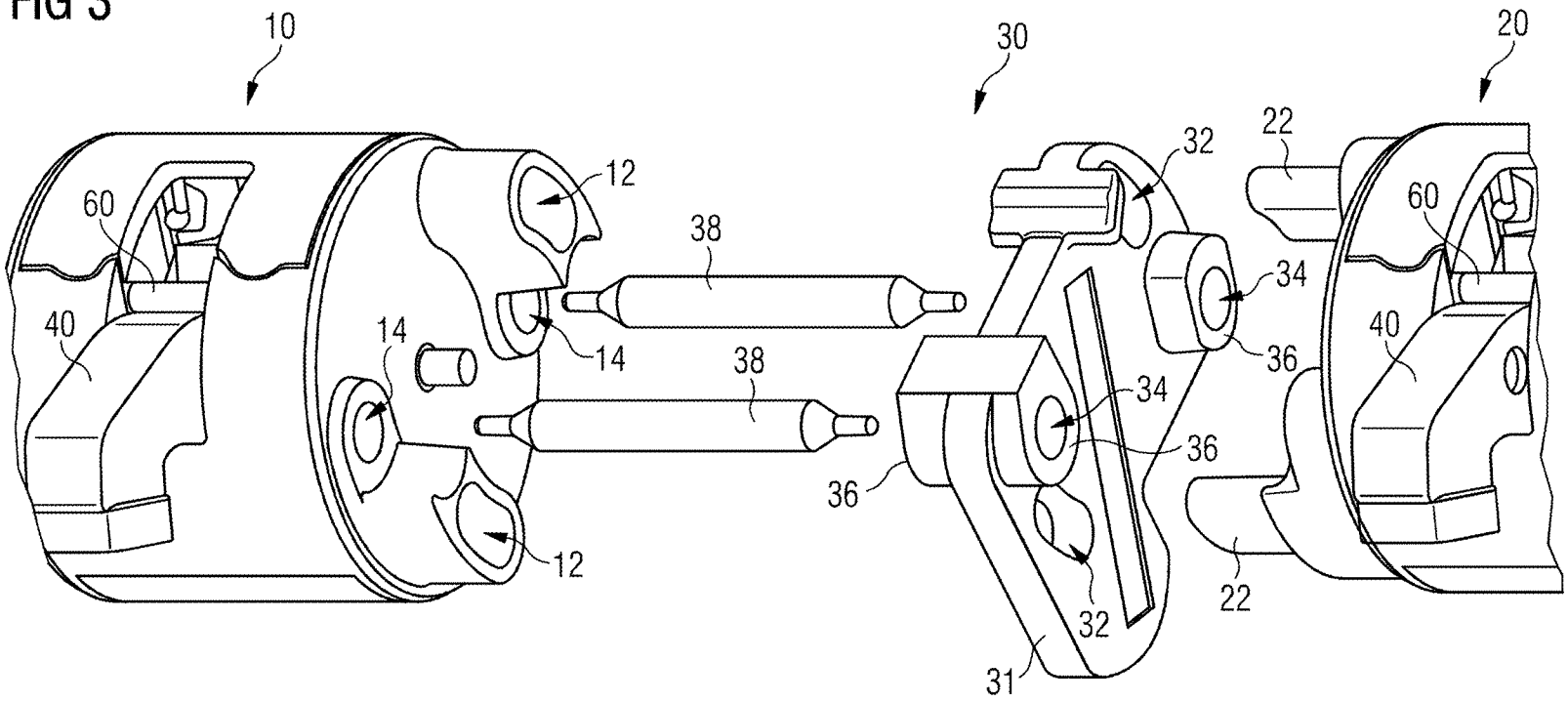
FIG. 3 shows an exploded representation of the carrier shaft according to the one embodiment of the present invention.

FIG. 3 shows an exploded representation of the carrier shaft 1 according to one embodiment of the present invention. As represented in FIG. 3, the carrier shaft 1 has one first carrier module 10, one second carrier module 20 and one connecting module 30, which is arranged in a torsion-inhibiting manner between the first carrier module 10 and the second carrier module 20. As FIG. 3 reveals, the connecting module 30 has a main body 31 and a connecting device 38 in the form of two connecting pins, which is arranged in, that is to say not just on, the main body 31, the at least one first carrier module 10 and the at least one second carrier module 20. To be more specific, according to the embodiment that is given by way of example, the two connecting pins are arranged in such a way that they extend through the main body 31. According to this embodiment, the connecting pins include a steel and the main body 31 includes a thermoplastic. Consequently, the material of the main body 31 has in principle a greater rigidity than the material of the connecting device 38.

As FIG. 3 also reveals, the main body 31 has two first through-holes 32, through which two carrier module projections 22 of the second carrier module 20 extend. Furthermore, the main body 31 has two second through-holes 34, through which the two connecting pins extend and are thereby arranged with a form fit. The two carrier module projections 22 of the second carrier module 20 are arranged in two first clearances 12 of the first carrier module 10 with a form fit. The first carrier module 10 and the second carrier module 20 respectively have two second clearances 14, in which the connecting device 38 in the form of the two connecting pins is arranged with a form fit. For easier assembly, the connecting pins are formed as tapering at their ends, so that they can be guided more easily into the second clearances 14 intended for them and in order to increase the guided length and thereby reduce the forces occurring there. The second clearances 14 are formed in a correspondingly complementary manner.

Figure 4:
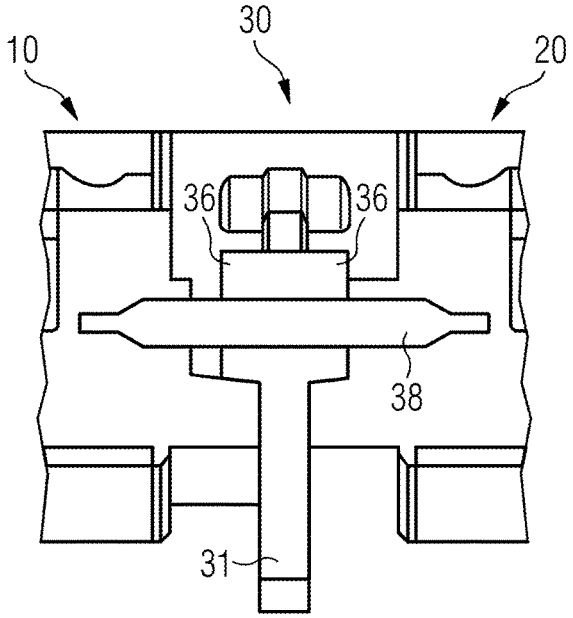
FIG. 4 shows a sectional representation of a connecting module of the carrier shaft according to the one embodiment of the present invention.

As shown in particular in FIG. 4, the carrier modules 10, 20 and the respective connecting module 30 comprising the main body 31 and the connecting device 38 are in direct contact with one another in a form-fitting manner. The main body 31 has the two second through-holes 34 in a portion in which the main body 31 has a greater thickness in the axial direction of the carrier shaft 1 than in another portion of the main body 31 as a result of a main body projection 36.

Figure 5:
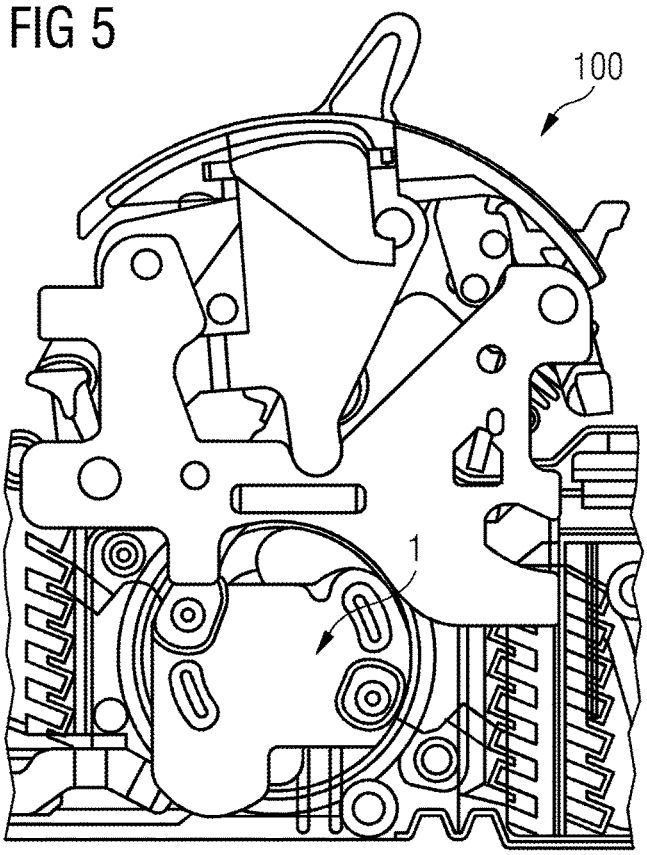
FIG. 5 shows a sectional representation of the electromechanical switching device with the carrier device 1 according to the present invention.

FIG. 5 schematically shows a sectional representation of the electromechanical switching device 100 with the carrier device 1 according to an embodiment of the present invention.

LIST OF DESIGNATIONS

1 carrier shaft
10 first carrier module
12 first clearance
14 second clearance
20 second carrier module
22 carrier module projection
30 connecting module
31 main body
32 first through-hole
34 second through-hole
36 main body projection
38 connecting device
40 contact arms
50 spring elements
60 bearing bolts
100 electromechanical switching device

What is claimed is:

1. A carrier shaft with a modular structure for an electromechanical switching device, comprising:

at least one first carrier module;

at least one second carrier module; and at least one connecting module, arranged in a torsion-inhibiting manner between the at least one first carrier module and the at least one second carrier module, the at least one connecting module including a main body and at least one straight connecting pin, the at least one straight connecting pin being arranged to pass through the main body and to be arranged in the main body, the at least one first carrier module and the at least one second carrier module.

2. The carrier shaft of claim 1, wherein the at least one straight connecting pin and the main body include different materials with different rigidities.

3. The carrier shaft of claim 1, wherein the at least one straight connecting pin includes metal or substantially metal.

4. The carrier shaft of claim 1, wherein the main body includes plastic or substantially plastic.

5. The carrier shaft of claim 1, wherein the main body includes at least one first through-hole, through which at least one of at least one carrier module projection of the at least one first carrier module and at least one carrier module projection of the at least one second carrier module extend.

6. The carrier shaft of claim 5, wherein at least one of:

the at least one carrier module projection of the at least one first carrier module is arranged in at least one first clearance of the at least one second carrier module with a form fit, and the at least one carrier module projection of the at least one second carrier module is arranged in at least one first clearance of the at least one first carrier module with a form fit.

7. The carrier shaft of claim 5, wherein the main body includes at least one second through-hole, in which the at least one straight connecting pin is arranged with a form fit.

8. The carrier shaft of claim 6, wherein the at least one first carrier module and the at least one second carrier module respectively have at least one second clearance, in which the at least one straight connecting pin is arranged with a form fit.

9. The carrier shaft of claim 5, wherein the main body includes at least one second through-hole in a portion in which the main body has a relatively greater thickness than in another portion of the main body.

10. An electromechanical switching device comprising the carrier shaft of claim 1.

11. The carrier shaft of claim 3, wherein the main body comprises plastic or substantially plastic.

12. The carrier shaft of claim 4, wherein the main body comprises thermoplastic.

13. The carrier shaft of claim 11, wherein the main body comprises thermoplastic.

14. The carrier shaft of claim 2, wherein the main body includes at least one first through-hole, through which at least one of at least one carrier module projection of the at least one first carrier module and at least one carrier module projection of the at least one second carrier module extend.

15. The carrier shaft of claim 2, wherein at least one of:

at least one carrier module projection of the at least one first carrier module is arranged in at least one first clearance of the at least one second carrier module with a form fit, and at least one carrier module projection of the at least one second carrier module is arranged in at least one first clearance of the at least one first carrier module with a form fit.

16. The carrier shaft of claim 6, wherein the main body includes at least one second through-hole, in which the at least one straight connecting pin is arranged with a form fit.

17. The carrier shaft of claim 15, wherein the at least one first carrier module and the at least one second carrier module respectively have at least one second clearance, in which the at least one straight connecting pin is arranged with a form fit.

18. The carrier shaft of claim 16, wherein the at least one first carrier module and the at least one second carrier module respectively have at least one second clearance, in which the at least one straight connecting pin is arranged with a form fit.

19. An electromechanical switching device comprising the carrier shaft of claim 2.

20. An electromechanical switching device comprising the carrier shaft of claim 17.

21. The carrier shaft of claim 1, wherein the at least one straight connecting pin is arranged to extend through the main body, and fit in the at least one first carrier module and the at least one second carrier module.

22. The carrier shaft of claim 1, wherein the at least one straight connecting pin includes at least two straight connecting pins.

23. The carrier shaft of claim 22, wherein the at least two straight connecting pins are arranged to each respectively extend through the main body, and each respectively fit in the at least one first carrier module and the at least one second carrier module.

24. An electromechanical switching device comprising the carrier shaft of claim 21.

25. An electromechanical switching device comprising the carrier shaft of claim 23.

26. The carrier shaft of claim 1, at least one straight connecting pin includes at least four straight connecting pins.

27. The carrier shaft of claim 1, at least one straight connecting pin includes at least four straight connecting pins, and wherein two straight connecting pins of the at least four straight connecting pins form a first pair of straight connecting pins, the first pair of straight connecting pins being arranged on or fitted in one side of the main body and one side of the at least one first carrier module, and wherein two straight connecting pins of the at least four straight connecting pins form a second pair of straight connecting pins, the second pair of straight connecting pins being arranged on or fitted in another side of the main body and another side of the at least one second carrier.

28. The carrier shaft of claim 1, wherein the at least one straight connecting pin includes a plurality of straight connecting pins, each respectively arranged on only one side of the main body.

29. An electromechanical switching device comprising the carrier shaft of claim 27.

30. An electromechanical switching device comprising the carrier shaft of claim 28.

* * * * *